US005960684A

United States Patent [19]

Bosley

[11] Patent Number: 5,960,684

[45] Date of Patent: Oct. 5, 1999

[54] TOOL FOR HARD TO REACH FASTENERS

[75] Inventor: Larry D. Bosley, House Spring, Mo.

[73] Assignee: Chrysler Corporation, Auburn Hills, Mich.

[21] Appl. No.: 08/989,535

[22] Filed: Dec. 12, 1997

[51] Int. Cl.[6] ..... B25B 13/16

[52] U.S. Cl. ..... 81/177.8; 81/177.1

[58] Field of Search ..... 81/177.1, 177.7, 81/177.8

[56] References Cited

U.S. PATENT DOCUMENTS

| | | | |
|---|---|---|---|
| 805,328 | 11/1905 | Tacchi et al. . | |
| 912,507 | 2/1909 | Tacchi . | |
| 916,613 | 3/1909 | Scruggs . | |
| 1,822,428 | 9/1931 | Zilliox | 81/177.8 |
| 2,156,285 | 5/1939 | Harris . | |
| 3,691,877 | 9/1972 | Harris . | |
| 3,802,303 | 4/1974 | Evans et al. . | |
| 3,839,929 | 10/1974 | Richards . | |
| 5,582,083 | 12/1996 | Baker | 81/177.8 X |

*Primary Examiner*—James G. Smith
*Attorney, Agent, or Firm*—Lawrence J. Shurupoff

[57] ABSTRACT

A hand tool includes a handle and an arm assembly. The handle has a mounting portion. A square peg on the mounting portion is removably secured in a square hole in a base of the arm assembly. The arm assembly includes a pair of parallel arms each have an inner end portion pivotally mounted to the base on a pair of pins which extend parallel to the axis of the peg. A tool is pivotally connected to the outer end portion of each of the parallel arms. The handle is capable of being mounted to the base of the arm assembly in a first position and in a second position rotated 180° from the first position.

14 Claims, 2 Drawing Sheets

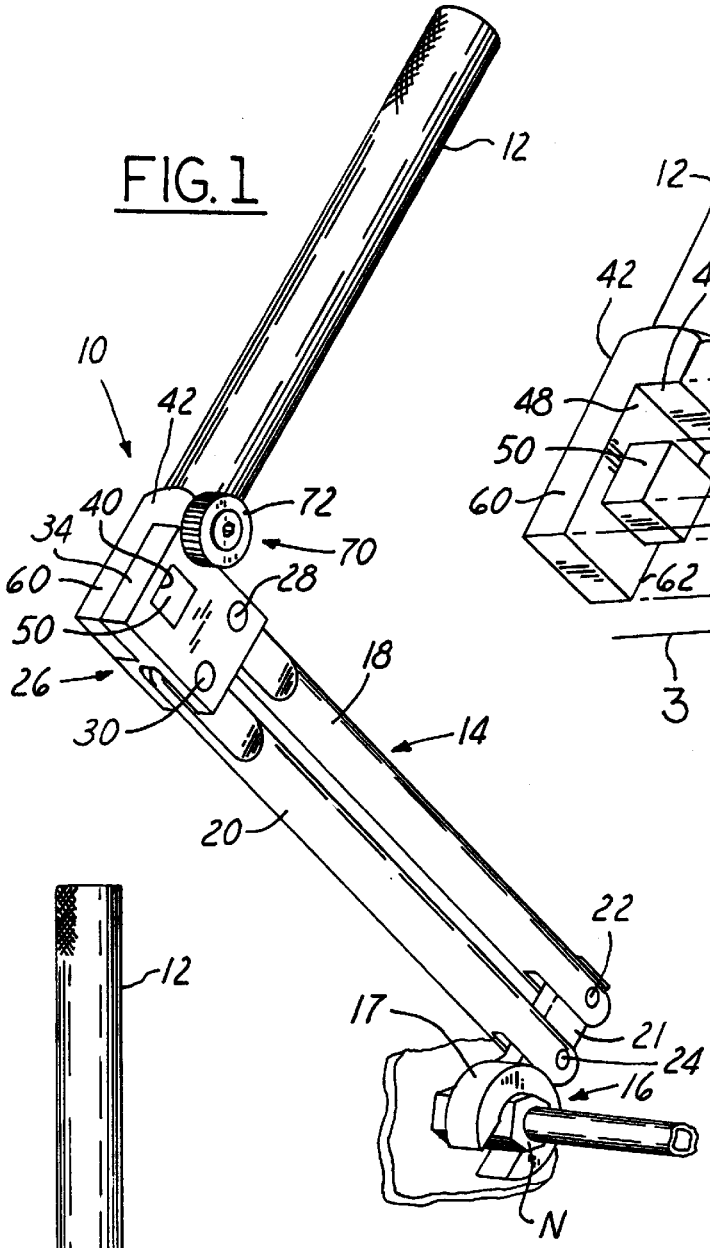
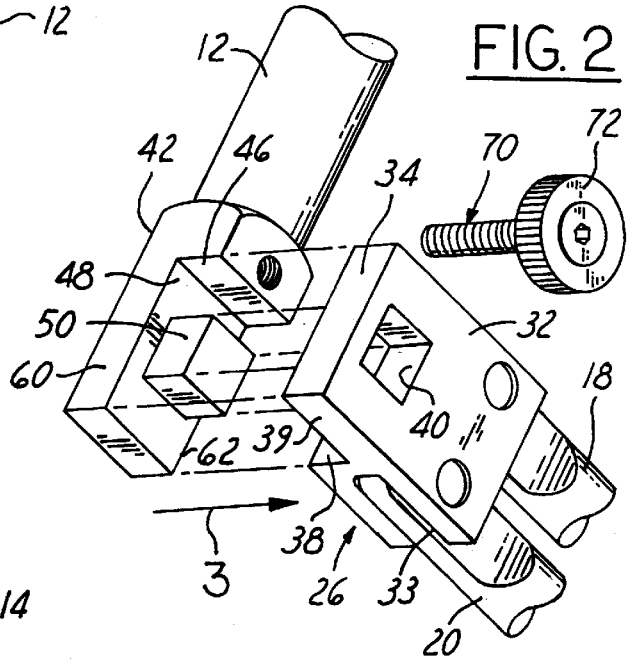
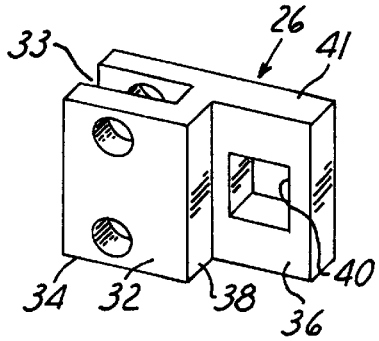
FIG. 3
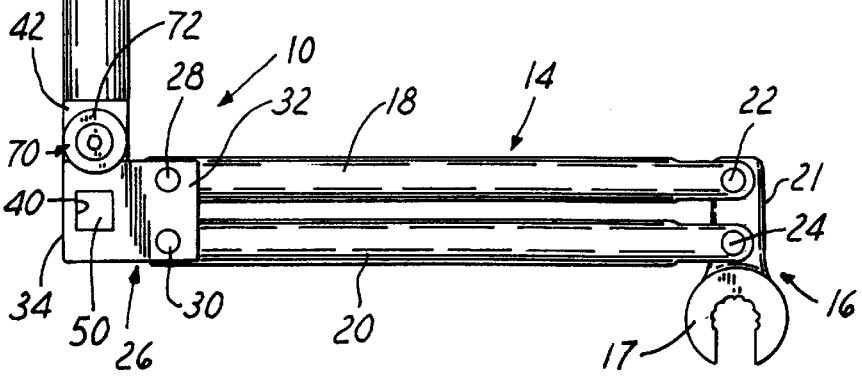
FIG. 4

TOOL FOR HARD TO REACH FASTENERS

FIELD OF INVENTION

This invention relates generally to hand tools and more particularly to a hand tool which is especially adapted for use with fasteners that are in hard-to-reach places.

BACKGROUND OF THE INVENTION

An ordinary wrench or pliers can be used to remove or apply a fastener if the fastener is within easy reach and readily accessible. Often, however, the fastener, due to its location, is not readily accessible. What is needed is a hand tool which is capable of almost universal use, even when the fastener is difficult to reach.

SUMMARY OF THE INVENTION

In accordance with the present invention, a hand tool is provided comprising an arm assembly having first and second parallel arms pivoted at one end to a base and at the other end to a tool. A handle is removably secured to the base.

More specifically, the handle has an end portion provided with a peg on which the base of the arm assembly is mounted. The base, arms and tool define a parallelogram linkage swingable in a plane which is parallel to the handle.

Preferably, the peg is rectangular so that the handle may be removed from a first position, rotated 180° and re-applied to the peg in a second position 180° from the first position.

In the preferred construction about to be described, the handle has a mounting portion formed with an L-shaped recess having first and second flat surfaces which are perpendicular to one another. The peg, which is preferably square, projects outwardly from the first flat surface. The base has a mounting portion provided with a square opening in which the peg is inserted with a close fit to connect the handle to the base with the handle disposed in a first position. The peg is removable from the hole to disconnect the handle from the base so that the handle can be rotated 180° to a second position and the peg re-inserted in the hole. The peg when inserted in the hole prevents rotation of the handle relative to the base. The mounting portion of the base has a flat surface in flush abutting engagement with the second flat surface of the recess in the mounting portion on the handle as a further means of preventing rotation of the handle relative to the base.

One object of this invention is to provide a hand tool having the foregoing features and capabilities.

Another object is to provide a hand tool which is constructed of a relatively few simple parts, is rugged and durable in use, and is capable of being readily manufactured and assembled.

These and other objects, features and advantages of the invention will become more apparent as the following description proceeds, especially when considered with the accompanying drawings.

BRIEF DESCRIPTION OF THE DRAWINGS

FIG. 1 is a perspective view of a hand tool constructed in accordance with the invention.

FIG. 2 is an enlarged exploded view showing portions of the hand tool in perspective.

FIG. 3 is a detail view of a base which forms part of the hand tool.

FIG. 4 is an elevational view of the hand tool showing the arm assembly in one position.

DETAILED DESCRIPTION OF THE PREFERRED EMBODIMENT

Figure 5:
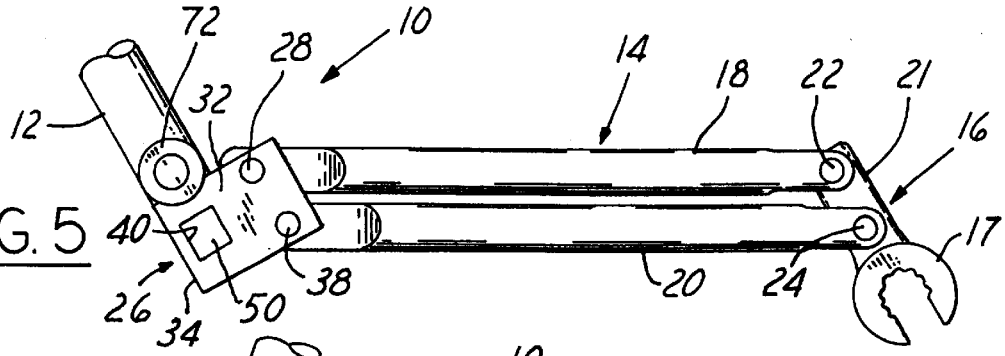
FIGS. 5 and 6 are views similar to FIG. 4, but show the arm assembly in different positions.
Figure 6:
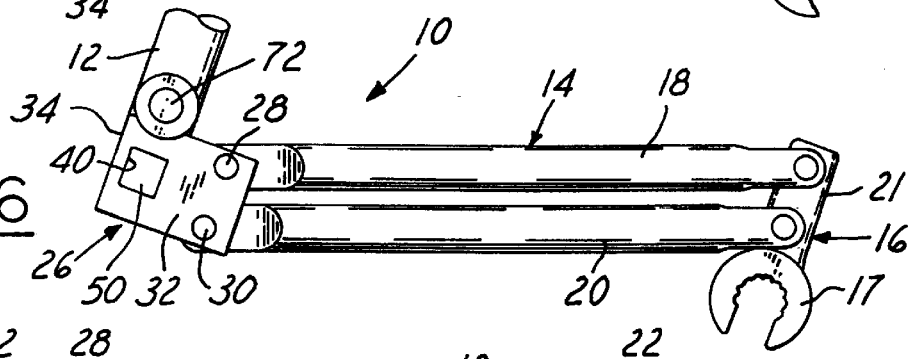

Referring now more particularly to the drawings, and especially to FIGS. 1–6, a hand tool 10 is shown having an elongated handle 12, an arm assembly 14, and a tool 16 having a claw 17 for gripping a fastener such as a nut N.

The arm assembly 14 comprises a pair of substantially identical, elongated, laterally spaced-apart, parallel arms 18 and 20. The outer ends of the arms are slotted to receive the shank 21 of the tool. The outer ends of the arms are pivoted to the shank 21 by pivot pins 22 and 24. The inner ends of the arms are pivoted to a base 26 by pivot pins 28 and 30. Pins 22, 24, 28 and 30 have parallel pivot axes.

More specifically, the base 26, which is shown in detail in FIG. 3, has a mounting portion 32 which is bifurcated to provide a slot 33 into which the inner ends of the arms 18 and 20 extend. The pivot pins 28 and 30 extend across the slot 33 through aligned holes on opposite sides of the slot. The pivot pins 22 and 24 at the outer ends of the arms are spaced from one another the same distance as the pivot pins 28 and 30 at the inner ends of the arms and are spaced from the respective pivot pins 28 and 30 the same distances so that the arm assembly 14 consisting of the base 26, arms 18 and 20 and the shank 21 of the tool, pivoted together by pins 22, 24, 28 and 30, form a parallelogram linkage.

The mounting portion 32 of the base 26 has an integral extension 34 to which the handle 12 is connected. The extension 34 has a flat surface 36 lying in a plane established by the longitudinal axes of the arms 18 and 20. The flat surface 36 together with a flat surface 38 of the mounting portion meet at right angles to form an L-shaped recess. A square hole 40 extends through the extension 34 with two opposite parallel sides of the hole parallel to the flat surface 38 and the remaining two sides perpendicular thereto. The extension 34 has flat parallel side surfaces 39 and 41.

The handle 12 has a mounting portion 42 at one end. The mounting portion 42 has an L-shaped recess formed by flat surfaces 46 and 48 which are perpendicular to one another. The surface 46 is perpendicular to the longitudinal centerline of the handle. The surface 48 lies on the longitudinal centerline of the handle. Projecting from surface 48 is a square peg 50 of substantially the same size and shape as the hole 40 in the extension 34 of the mounting portion 32 of the base 26. The peg 50 extends outwardly from the surface 48 on an axis which is parallel to the pivot pins 22, 24, 28 and 30. The peg 50 is adapted to be received in the hole 40 with a close fit preventing rotation of the handle relative to the base. Two opposite parallel sides of the peg 50 are parallel to the surface 46 and the remaining two sides are perpendicular thereto. The mounting portion 42 of the handle has opposite flat side surfaces 60 and 62 which are parallel to the longitudinal centerline of the handle.

When the handle 12 is secured to the base 26, the handle extends parallel to the plane of swinging movement of the arm assembly 14, and parallel to the shank 21 of the tool.

When assembled as in FIGS. 1 and 4–6, the peg 50 is received in the hole 40 with the surfaces 36 and 48 in flush surface-to-surface engagement and with the flat side surface 62 in flush surface-to-surface engagement with the flat surface 38 of the body portion of the base 26. The peg 50 and hole 40 prevent the handle 12 from rotating relative to the base 26 of the arm assembly 14. The engagement of the surface 62 of the mounting portion of the handle 12 with surface 38 of the base 26 also prevents rotation of the handle 12 relative to the base 26 of the arm assembly 14. The side surface 41 of the extension 34 of the base 26 is in flush surface-to-surface engagement with the surface 46 of the mounting portion 42 of the handle to also prevent rotation of the handle relative to the base 26 of the arm assembly 14. The handle 12 is parallel to the shank 21 of the tool in all positions (compare FIGS. 4–6) and parallel to a straight line connecting the pivot pins 28 and 30.

A screw 70 threads through the mounting portion 42 of the handle and has a head 72 engaging the base 26 to releasably secure the handle and arm assembly together.

Figure 7:
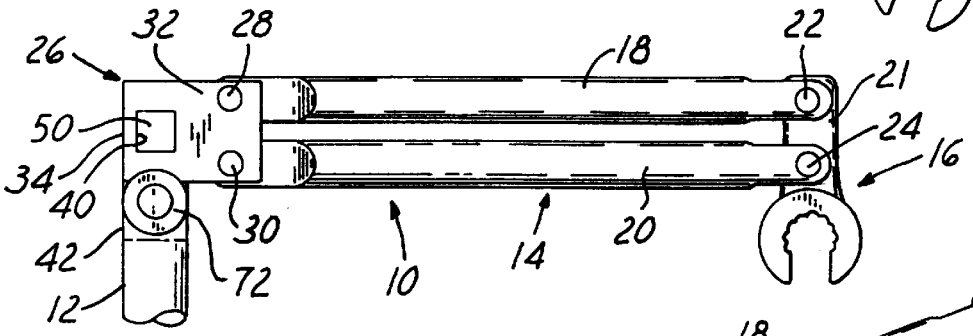
FIG. 7 is similar to FIGS. 5 and 6, but shows the handle extending from the arm assembly in a position rotated 180° from the position in FIGS. 1 and 4–6.
Figure 8:
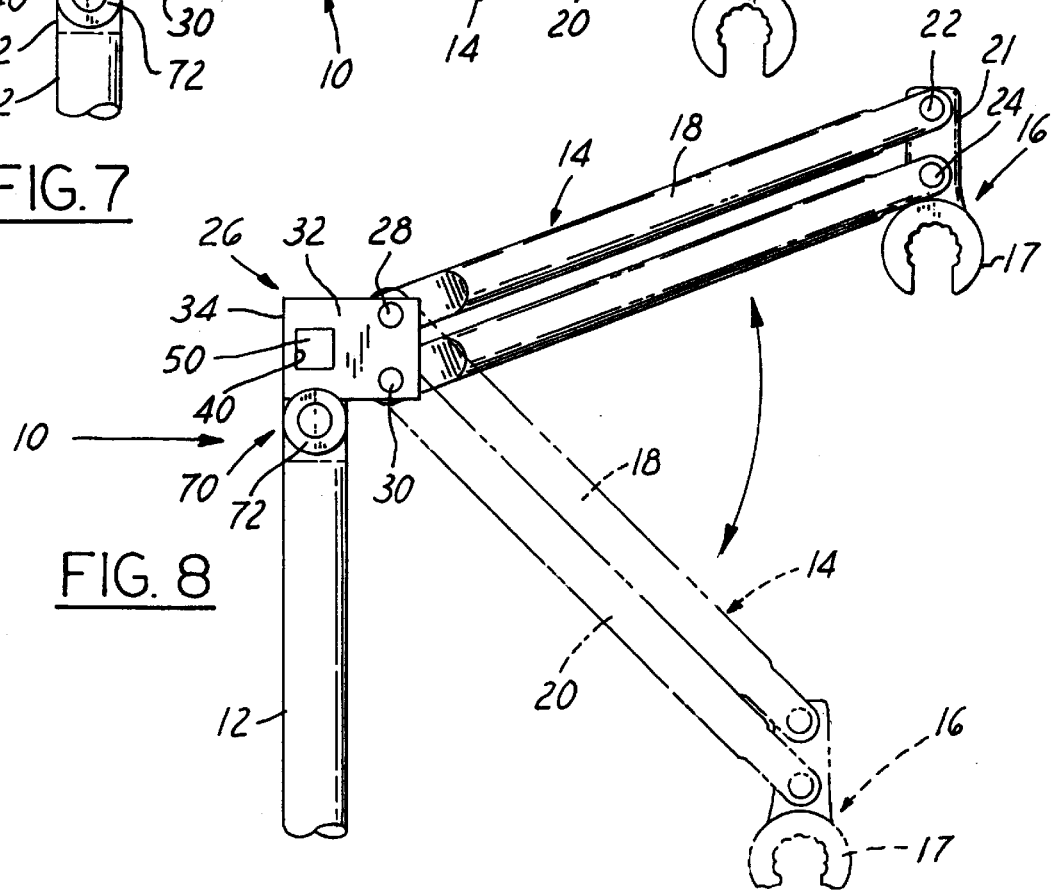
FIG. 8 is a view similar to FIG. 7, showing the arm assembly in one position in solid lines and in a different position in broken lines.

The peg 50 is removable from the hole 40 to disconnect the handle 12 from the base 26 so that the handle can be rotated 180° to a second position and the peg re-inserted in the hole. This arrangement is shown in FIGS. 7 and 8. In this alternate position of the handle, the peg 50 and hole 40 prevent the handle 12 from rotating relative to the base 26 of the arm assembly 14. The engagement of the surface 60 of the mounting portion of the handle 12 with the surface 38 of the base 26 also prevents rotation of the handle 12 relative to the base 26 the arm assembly 14. Surface 39 of the extension 34 of the base 26 is in flush engagement with the surface 46 of the mounting portion 42 of the handle as a further means of preventing relative rotation. Likewise, in this alternate condition, the handle 12 is parallel to the shank 21 of the tool.

The various figures show the flexibility and adaptability of the tool of this invention, enabling it to be used in many difficult situations where the fastener is not readily accessible but can be reached by the tool of this invention.

What is claimed is:

1. A hand tool, comprising:

a handle having a mounting portion and a longitudinal axis, a mounting peg provided on said mounting portion of said handle and having an axis extending perpendicular to the longitudinal axis of said handle, an arm assembly comprising a base removably mounted to said handle via said peg, a threaded member threaded into said mounting portion and engaging said base so as to releasably secure said handle and said arm assembly together, a pair of parallel arms each having an inner end portion pivotally mounted to said base on a pair of pins extending parallel to said axis of said peg and a slotted outer end portion, and a tool pivotally connected within said slotted outer end portion of each of said arms.

2. The tool of claim 1, wherein said peg is rectangular and wherein said base has a rectangular hole closely fitted over said peg.

3. The tool of claim 1, wherein said tool comprises a shank having an axis extending parallel with said axis of said handle.

4. The hand tool of claim 1, wherein said arm assembly is mountable to said handle in a first position and in a second position rotated 180° from said first position.

5. A hand tool comprising an arm assembly having first and second parallel arms, each of said arms having an inner end portion and a slotted outer end portion, a base, spaced apart first and second pins pivotally connecting said base to an inner end portion of each of said arms, a tool, spaced apart third and fourth pins pivotally connecting said tool within said slotted outer end portion of each of said arms, said pins having parallel axes, said base, arms and tool defining a parallelogram linkage swingable in a plane perpendicular to the axes of said pins, an elongated handle having a mounting portion removably secured to said base and extending parallel to said plane; and a threaded member threaded into said mounting portion and engaging said base so as to releasably secure said handle and said arm assembly together.

6. The hand tool of claim 5, wherein said tool has a shank extending parallel to said handle.

7. The hand tool of claim 5, wherein said handle has an end portion provided with a rectangular mounting peg, and said base has a rectangular opening non-rotatably and releasably receiving said peg.

8. The hand tool of claim 5, wherein said handle has an end portion provided with a mounting peg, said base has an opening releasably receiving said peg, and cooperating abutting surfaces on said end portion of said handle and on said base preventing rotation of said base relative to said handle.

9. The hand tool of claim 5, wherein said handle has a first mounting portion, said base has a second mounting portion, a mounting peg on one of said mounting portions, an opening in the other of said end portions removably receiving said peg, and means preventing rotation of said peg in said opening.

10. The hand tool of claim 9, wherein said peg is rectangular and said opening is rectangular and fits closely on said peg to provide said rotation preventing means.

11. The hand tool of claim 10, and further including cooperating abutting surfaces on said first and second mounting portions to provide said rotation preventing means.

12. The hand tool of claim 5, wherein said handle has a first mounting portion formed with an L-shaped recess having first and second flat surfaces perpendicular to one another, a square peg projecting from said first surface, said base has a second mounting portion, a square opening in the second mounting portion of said base in which said peg is inserted with a close fit to connect said handle to said base with said handle disposed in a first position, said peg being removable from said hole to disconnect said handle from said base so that said handle can be rotated 180° to a second position and said peg re-inserted in said hole, the peg when inserted in said hole preventing rotation of said handle relative to said base.

13. The hand tool of claim 12, wherein said second mounting portion of said base has a flat surface in flush abutting engagement with said second flat surface of said recess as a further means of preventing rotation of said handle relative to said base.

14. The hand tool of claim 13, wherein said tool has a shank extending parallel to said handle.

* * * * *